US006703769B2

(12) United States Patent
Yamane et al.

(10) Patent No.: US 6,703,769 B2
(45) Date of Patent: Mar. 9, 2004

(54) SHORT-ARC TYPE DISCHARGE LAMP HAVING VENTILLATION APERTURES AT THE BOTTOM OF THE BASES

(75) Inventors: Takumi Yamane, Himeji (JP); Takeo Matushima, Himeji (JP); Kazuhiro Inaoka, Kakogawa (JP); Kyosuke Fujina, Shiso-gun (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 321 days.

(21) Appl. No.: 09/774,063

(22) Filed: Jan. 31, 2001

(65) Prior Publication Data

US 2001/0010447 A1 Aug. 2, 2001

(30) Foreign Application Priority Data

Feb. 1, 2000 (JP) ..... 2000-023436

(51) Int. Cl.[7] ..... H01J 1/58

(52) U.S. Cl. ..... 313/46; 313/113

(58) Field of Search ..... 313/46, 25, 30, 313/39, 42, 43, 113, 510, 571, 624, 625, 318.02

(56) References Cited

U.S. PATENT DOCUMENTS 5,013,962 A * 5/1991 Desclos ..... 313/318.02
5,025,192 A * 6/1991 Okamoto ..... 313/623
5,168,302 A * 12/1992 Watanuki ..... 355/30
5,359,255 A * 10/1994 Kawai et al. ..... 313/17
5,525,856 A * 6/1996 Kawai et al. ..... 313/114
5,717,277 A * 2/1998 Siminovitch ..... 313/318.02

* cited by examiner

*Primary Examiner*—Harshad Patel
(74) *Attorney, Agent, or Firm*—Nixon Peabody LLP; David S. Safran

(57) ABSTRACT

To provide a long-lived short-arc type discharge lamp and light-source device in which high temperature oxidation of external lead rods is inhibited, a short-arc type discharge lamp of the type in which external lead rods (24) are electrically connected to electrodes (21, 22) that extend from sealing tubes (12) that are located at each of opposite ends of an emission envelope (11), and in external lead rods are electrically connected via lead lines (25) to bases (30) that are attached to a respective sealing tube, by a first ventilation aperture (31) being formed in a peripheral wall of each base and second ventilation aperture (32) being formed in the tail end of at least one base. Ventilation-concentration hoods (28) that conduct cooling air can be mounted at the first aperture. The lamp is held by fixing the periphery of each base in a lamp support plate (51).

7 Claims, 6 Drawing Sheets

SHORT-ARC TYPE DISCHARGE LAMP HAVING VENTILLATION APERTURES AT THE BOTTOM OF THE BASES

BACKGROUND OF THE INVENTION

1. Field of the Invention

The present invention concerns a short-arc type discharge lamp and a light-source device that uses a short-arc type discharge lamp.

2. Description of Related Art

In recent years, liquid-crystal projectors and DMD projectors have come into extensive use as presentation tools, and short-arc type discharge lamps, such as metal halide lamps or mercury lamps, have been used since high brightness is required of such light sources for projection. In addition, short-arc type xenon lamps have been used in projector light sources that project large pictures.

Short-arc type discharge lamps, for example, xenon lamps, have a pair of electrodes disposed facing each other within a quartz glass emission envelope in which xenon gas is sealed, and a sealing tube is connected to each of opposite sides of the emission envelope. Electrode core rods with electrodes formed at the tips are hermetically sealed within the sealing tube in step-seamed glass sealed lamps. The electrode core rods extend out from the step-seamed glass section and double as external lead rods, and the lead lines comprising twisted wires are connected to the tail edge of the external lead rods by soldering. In addition, the cylindrical bases with bottoms are bonded by adhesive to the sealing tube, and the external lead rods and the lead lines are covered by this base. The edge of the lead wire is connected to the terminal of the base.

The foil sealing method, in which the edge of the electrode core rod and the edge of the external lead rods are individually connected to metal foil and the metal foil is hermetically embedded in the sealing tube, may be used instead of the step-seamed glass sealing method.

Incidentally, projector light-source devices reach extremely high temperatures during lighting of xenon lamps that are disposed in the casing, and external lead rods made of tungsten or molybdenum also reach high temperatures. When external lead rods reach high temperatures, the step-seamed glass section also reaches high temperatures and distortion develops. Such distortion brings about cracking of step-seamed glass.

Furthermore, oxidation rapidly proceeds at high temperatures since the external lead rods within the base are exposed to the atmosphere. Force that spreads open quartz glass comprising the step-seamed glass sealing sections acts when such oxidation is transmitted to the section of the external lead rods within the sealing tube, and that also can generate cracking.

The external lead rods and metal foil within the foil seal section oxidize when a lamp reaches extremely high temperatures even in the case of a foil sealed lamp, and the quartz glass comprising the foil seal section cracks.

For this reason, a pair of ventilation apertures facing each other have been formed about the periphery of the base or cooling fins have been established on the outer surface of the base in the past. However, cooling air within the light-source device often flows along the axial direction of the lamp even if ventilation apertures are formed about the periphery of the base, so that little cooling air flows to the interior of the base from the ventilation aperture orthogonally to the axis of the lamp, and the external lead rods within the base cannot be adequately cooled. The cooling air entering the base and circulating along the external lead rods results in cooling only of a narrow region of the external lead rods. Furthermore, since cooling fins established on the outer surface of the base effect cooling by using the heating attributable to thermal conduction, the external lead rods within the base cannot be adequately cooled by these either.

Recently, limits have been imposed on the overall lamp length in light of the demand for miniaturization of projectors, and the gap between external lead rods and electrodes, which reach high temperatures during lighting, has become narrower. Accordingly, the temperature elevation of external lead rods has become increasingly pronounced, and the problem of shorter lamp life attributable to high temperature oxidation of external lead rods has been demonstrated.

SUMMARY OF THE INVENTION

Thus, the purpose of the present invention is to provide a short-arc type discharge lamp and a light-source device that uses a short-arc type discharge lamp in which high temperature oxidation of external lead rods is restricted to prolong lamp life.

To attain such objectives, the invention provides a short-arc type discharge lamp in which a pair of electrodes are disposed facing each other within an emission envelope made of quartz glass, external lead rods electrically connected to said electrodes extend from sealing tubes connected to each of opposite ends of the emission envelope, and are electrically connected to cylindrical bases with bottoms that are attached to at least one of the sealing tubes, a first aperture is formed for ventilation about the periphery of the bases and a second aperture for ventilation is formed at the tail edge of at least one of the bases to facilitate the circulation of cooling air within the bases and to thereby adequately cool the external lead rods within the bases.

Also in accordance with the invention, a heat dissipation section is formed at the external lead rods or the lead lines within the base. Additionally, according to the invention, a ventilation-concentration hood can be provided which conducts cooling air to the first aperture for ventilation, and that permits more efficient cooling of the external lead rods within the base.

The invention also concerns a light-source device in which the short-arc type discharge lamp and a concave reflection mirror surrounding this short-arc type discharge lamp are disposed in a casing, wherein a threaded section is formed about the periphery of the base, an attachment hole is formed in the lamp retaining plate, and the short-arc type discharge lamp is retained by inserting said base in the attachment hole of the lamp retaining plate and screwing it.

The mode of implementing the present invention is explained in detail with reference to the appended diagrams.

DETAILED DESCRIPTION OF THE INVENTION

Figure 1:
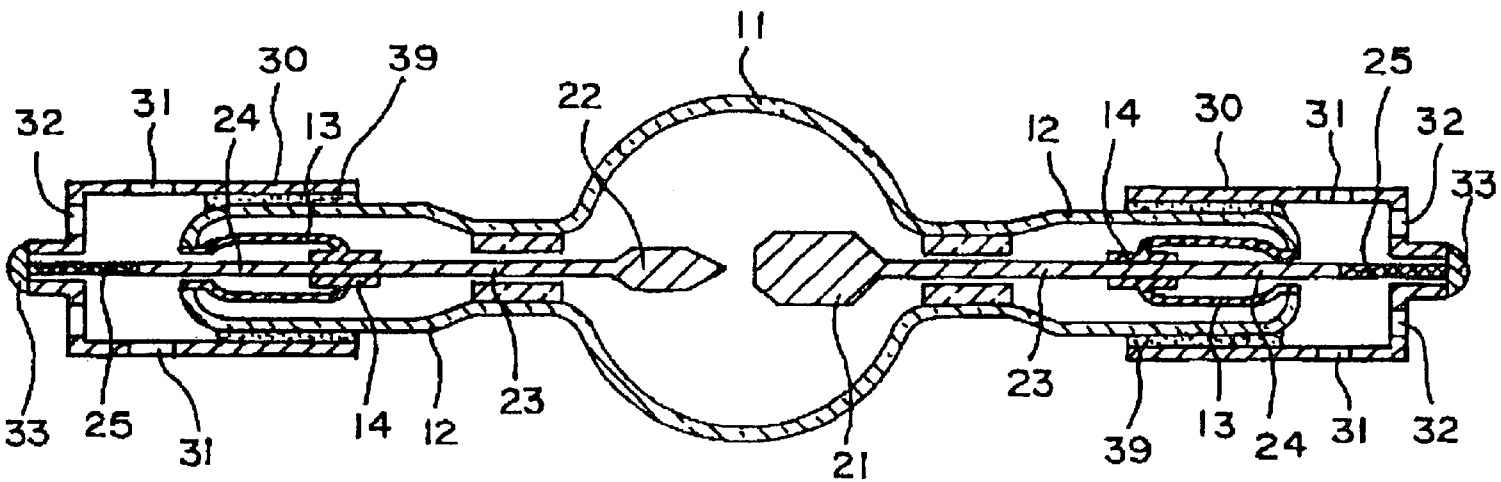
FIG. 1 is a sectional view of a step-seamed sealed xenon lamp in accordance with the present invention.

FIG. 1 shows a short-arc type xenon lamp that is sealed by the step-seamed glass sealing method. In FIG. 1, a roughly spherical emission envelope 11 is made of quartz glass and has sealing tubes 12 integrally formed at each of opposite ends. Xenon gas is sealed within emission envelope 11 and an anode 21 and a cathode 22 pair of electrodes are disposed facing each other within the envelope 11. Anode 21 and cathode 22 are integrally joint to the tips of electrode core rods 23 made of tungsten.

Step seamed glass sections 13 are disposed within sealing tubes 12 and the pair of electrode core rods 23 are hermetically sealed by sealing sections 14 of step seamed glass sections 13. Accordingly, electrode core rods 23 protrude from sealing sections 14 so that the protrusions double as external lead rods 24. Lead lines 25, comprising twisted wires, are connected at the tips of external lead rods 24 by soldering. Bottomed cylindrical bases 30 are bonded by adhesive 39 to the sealing tubes 12, and the external lead rods 24 as well as lead lines 25 are situated in a space formed within the bases 30. The tips of lead lines 25 are then connected by solder to contact points 33 of bases 30.

Figure 2:
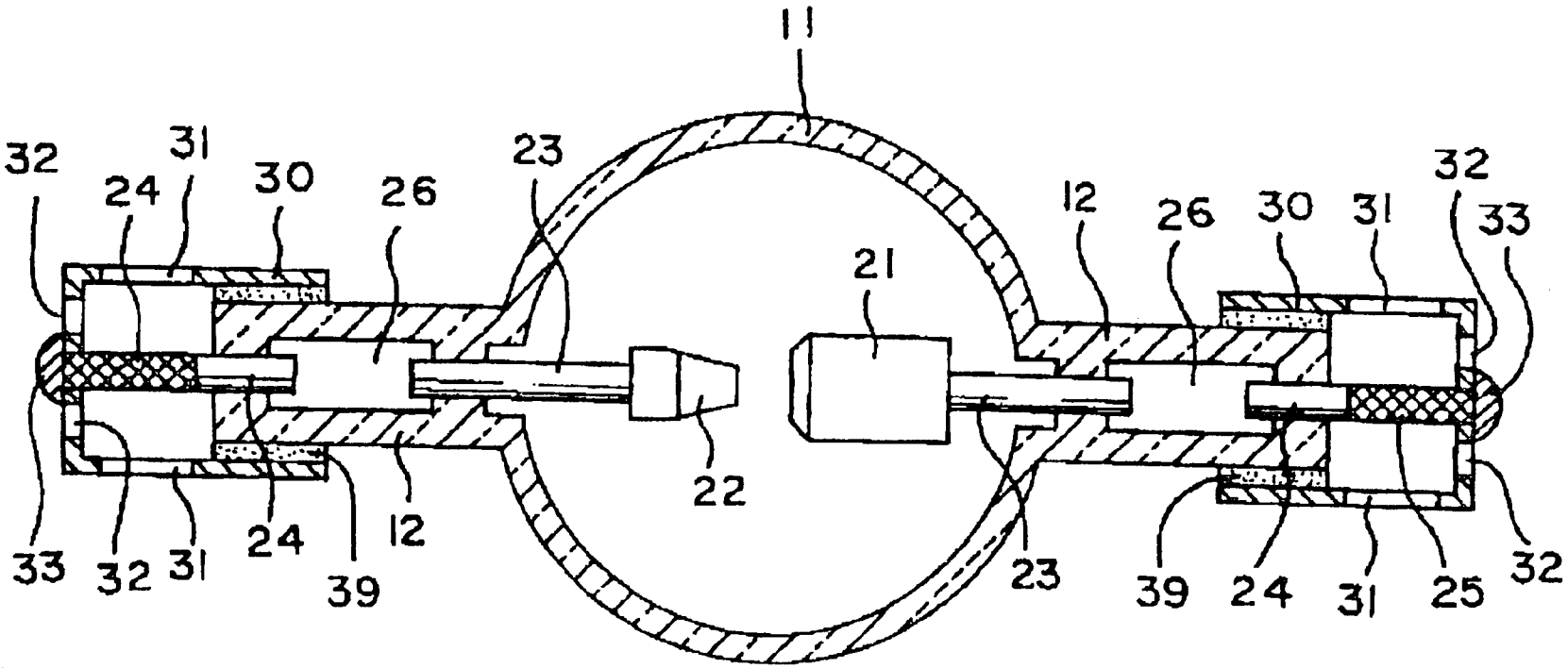
FIG. 2 is a sectional view of a foil-sealed xenon lamp according to the present invention.

FIG. 2 shows a short-arc type xenon lamp sealed by the foil sealing method. In FIG. 2, the tips of electrode core rods 23 are welded to metal foil 26 made of molybdenum and a tip of each external lead rod 24 is welded to each metal foil 26. Metal foils 26 are disposed within sealing tubes 12, the quartz glass of sealing tubes 12 is softened by heating and contracted to form a de-pressurized state within sealing tubes 12, thereby embedding metal foils 26 within sealing tubes 12 and sealing them. The softened sealing tubes 12 are crimped to complete embedding of metal foils 26. Other structures are identical with those of the xenon lamp shown in FIG. 1.

In both cases, at least one (two being shown) first ventilation aperture 31 is formed in the periphery of each base 30, and at least one (two being shown) second ventilation aperture 32 is also formed in the tail end of each base 30. Accordingly, since cooling air flows within the device in the axial direction of the xenon lamp, cooling air enters bases 30 from second ventilation apertures 32 formed when the bases 30 are situated upstream of the flow of cooling air and it flows along the lead lines 25 and the external lead rods 24, then exhausting from the first ventilation apertures 31. Cooling air enters bases 30 from first apertures 31, flows along external lead rods 24 and lead lines 25, and exhausts from second aperture 32 when the bases 30 are situated downstream of the flow of cooling air.

In both cases, a greater amount of cooling air can be circulated within bases 30 than when the direction of flow of cooling air within bases 30 is orthogonal to the direction of flow of cooling air within the device as occurs when ventilation apertures are established only in the periphery of the bases 30 since the direction of flow of cooling air within bases 30 coincides with the direction of flow of cooling air within the device. Furthermore, external lead rods 24 are cooled more efficiently coupled with the influx of large amounts of cooling air within bases 30 since cooling air entering bases 30 flows along external lead rods 24 and lead lines 25 that are connected to external lead rods 24.

Figure 3A:
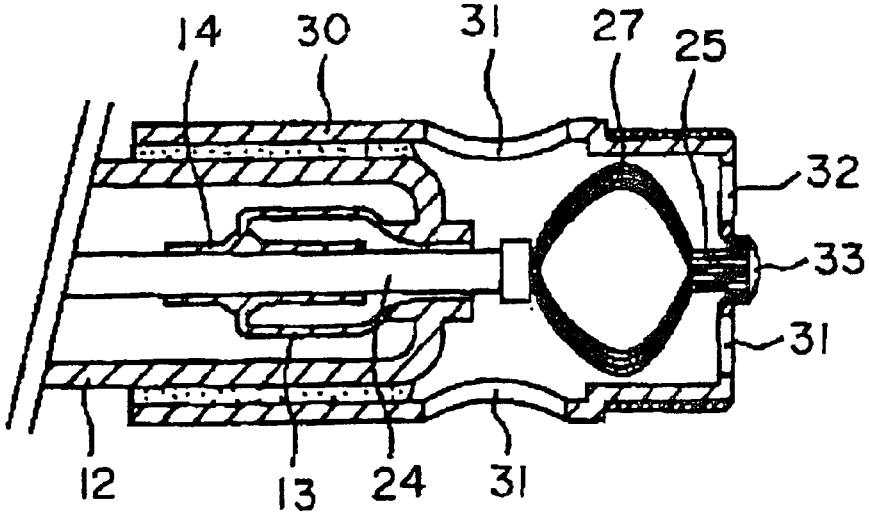
FIGS. 3(*a*) & 3(*b*) are sectional views of embodiments in which a heat dissipation section is provided.
Figure 3B:
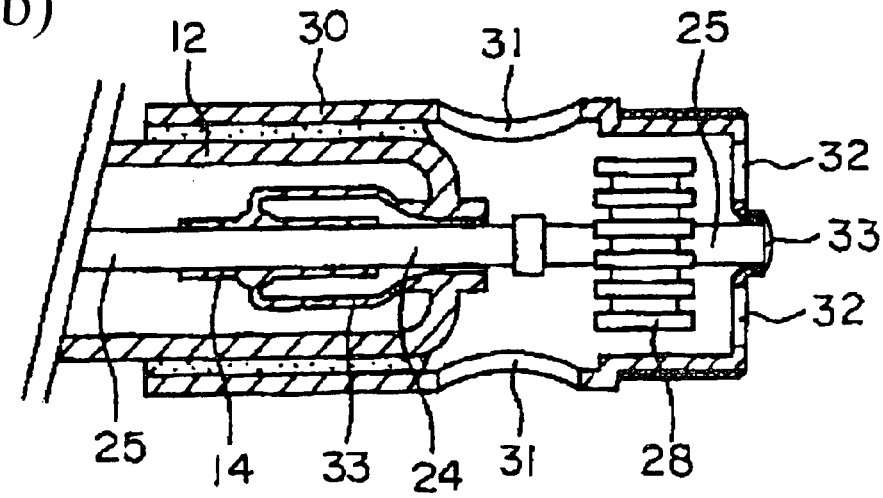

A heat dissipation section should be established in external lead rods 24 and lead lines 25 to cool external lead rods 24 more efficiently. FIG. 3(*a*) shows an example of a heat dissipation section 27 in which the twisted wires forming lead lines 25 are disentangled to form an expansion section to increase the contact area with cooling air. FIG. 3(*b*) shows an example in which cooling fins are attached to the lead lines 25 to form heat dissipation section 28. Cooling fins may be attached to external lead rods 24 when external lead rods 24 within each base are long.

Figure 4A:
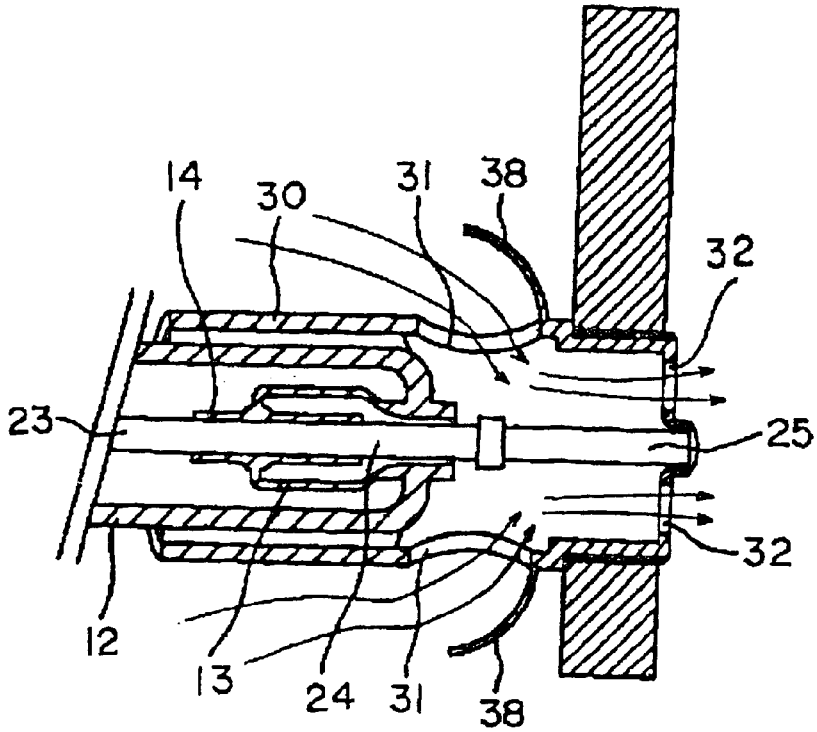
FIGS. 4(*a*) & 4(*b*) are sectional views of embodiments in which ventilation-concentration hoods are provided.
Figure 4B:
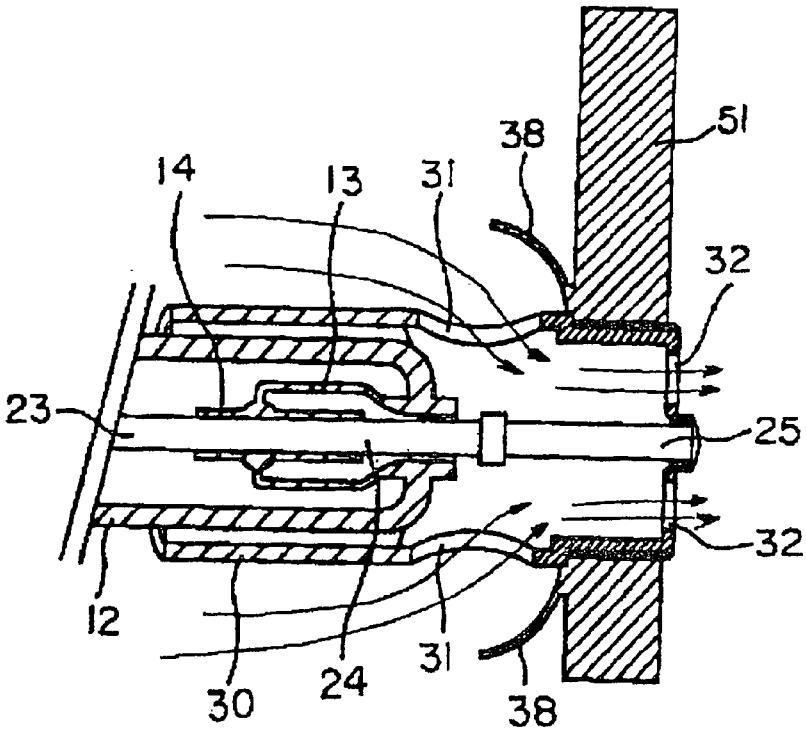

Ventilation-concentration hoods 38 may be mounted as shown in FIGS. 4(*a*) & 4(*b*) to inject large amounts of cooling air from the first ventilation apertures 31 which are formed about the periphery of bases 30 downstream of the cooling air into each base 30. FIG. 4(*a*) shows the case in which ventilation-concentration hoods 38 are attached integrally with bases 30, while FIG. (4*b*) shows the case in which ventilation-concentration hoods 38 are attached integrally with lamp support plate 51. However, in both cases, the direction of flow of cooling air along the xenon lamp can be forcibly altered by ventilation-concentration hoods 38 to conduct more cooling air into each base 30.

Figure 5:
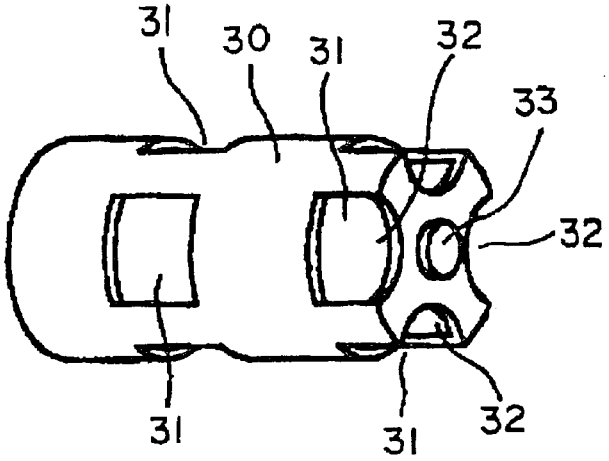
FIG. 5 is a perspective view of another embodiment of the bases.

There are no specific limitations on the number, shape or aperture area of first ventilation apertures 31 and second ventilation apertures 32, but increasing the sum of the aperture areas as much as possible is desirable. Furthermore, apertures may be cut at the corners of bases 30, as shown in FIG. 5, so that part of the corner aperture constitutes first ventilation aperture 31 and part of the corner aperture constitutes the second ventilation aperture 32.

The shapes of the lamps shown in FIGS. 1 & 2 are symmetrical, and the heating conditions on both the cathode side and the anode side are roughly equal. Consequently, if the second aperture 32 is formed in the base 30 on the cathode side and in the base 30 on the anode side, and one of the sealing tubes 12 is lengthened to moderate the heating conditions of external lead rods 24, the second aperture 32 need only be formed at base 30 on the side where sealing tube 12 is shorter and experiences more severe heating conditions.

Figure 6:
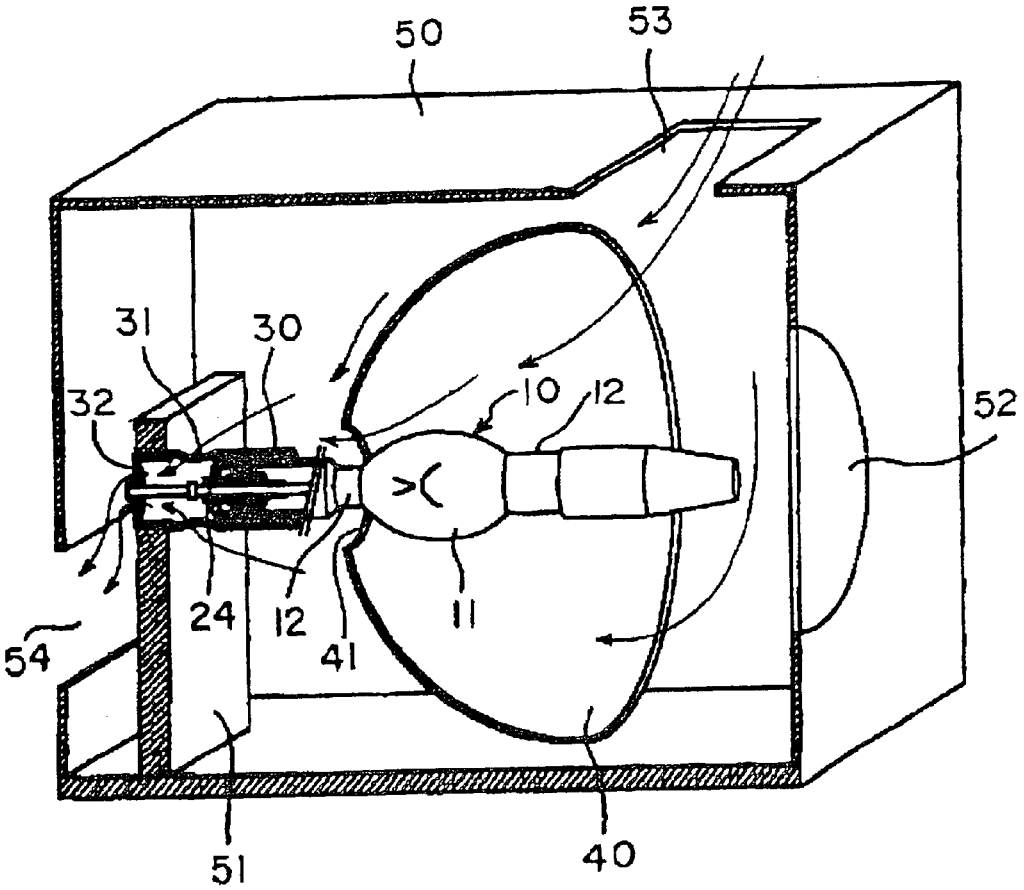
FIG. 6 is a perspective view of the light-source device.

FIG. 6 shows the light-source device in which the short-arc type xenon lamp 10 shown in FIG. 1 is the light-source lamp. Light output aperture 52 is formed at the front of box-shaped casing 50. In addition, cooling air inlet aperture 53 is formed at the top of casing 50 while cooling air vent aperture 54 is formed at the back. Xenon lamp 10 with consumed power of 2000 W, for example, and concave reflection mirror 40 are disposed within casing 50.

Figure 7A:
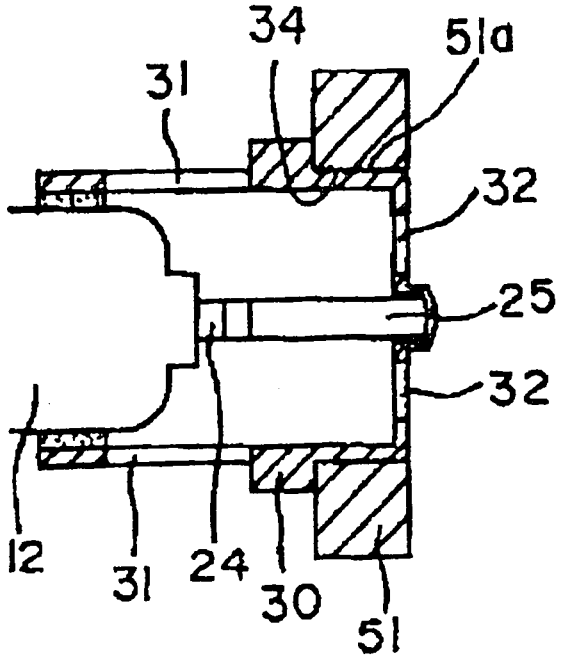
FIGS. 7(*a*) and 7(*b*) are cross-sectional views for explaining two different versions of the lamp support structure.
Figure 7B:
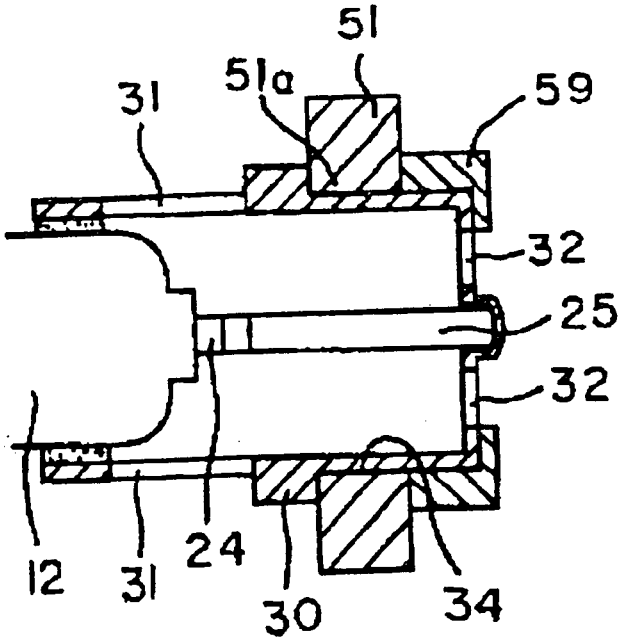

The xenon lamp 10 is held by a lamp support plate 51 that is erected on the bottom of casing 50. Threaded section 34 is formed about the periphery of each base 30, as shown in FIG. 7(*a*). An attachment hole 51*a* is opened in lamp support plate 51, and threads are formed on the inner surface of attachment hole 51*a* as well. Base 30 is fixed to lamp support plate 51 by screwing threaded section 34 of base 30 into attachment hole 51*a*. FIG. 7(*b*) shows an example in which base 30 is fixed to lamp support plate 51 by inserting base 30 into attachment hole 51*a* and screwing nut member 59 into threaded section 34 without forming any threads on the inner surface of attachment hole 51*a*. In both cases, large amounts of cooling air can enter base 30 since second aperture 32 formed at the tail end of base 30 does not hinder lamp support plate 51 and is not obstructed by it.

The reflection surface of concave reflection mirror 40 has an aperture 41 formed at its apex. One sealing tube 12 of xenon lamp 10 is inserted in aperture 41, and concave reflection mirror 40 surrounds xenon lamp 10 so that the optical axis matches the axis of xenon lamp 10.

However, light released from the are bright point formed between the electrodes reflects off concave reflection mirror 40 and is emitted from the light output aperture 52 when the xenon lamp 10 is lit. In addition, cooling air enters casing 50 from cooling air inlet aperture 53 and cools the xenon lamp 10 as well as the concave reflection mirror 40. As mentioned above, the external lead rod 24 is efficiently cooled since large amounts of cooling air enter base 30 from the first aperture 31 of base 30 and exit via the second aperture 32. The cooling air is exhausted via cooling air vent aperture 54.

The temperature of external lead rods 24 during lighting were actually measured in a light-source device using xenon lamp 10 with power consumption of 2000 W. The site of temperature measurement was the surface of external lead rod 24 near sealing sections 14. The cooling air had a static pressure of 40 Pa and air volume of 2 $m^3$/min. In addition, the temperature of a conventional xenon lamp without a second aperture 32 at the tail end of the base 30 was similarly measured. The results indicated the temperature of external lead rods in this embodiment to be 420° C. while the temperature in a conventional example was 500° C. In short, the temperature difference was about 80° C.

Incidentally, the step-seamed glass section cracked in the xenon lamp of this embodiment within 500 to 1000 hours of operation at 500° C., but cracks did not develop at 420° C. even after the elapse of over 2000 hours. As for glass cracking at the seal due to oxidation of metal foil or external lead rods, the life of the seal is concluded to be prolonged by an order of magnitude when the temperature falls below 150° C. Accordingly, if the seal life is 2000 hours when the temperature of the external lead rods is 500° C., the life of the seal of a xenon lamp pursuant to this embodiment would be expected to be 8000 hours if the temperature of the external lead rods is 420° C.

Effects of Invention

As explained above, external lead rods are efficiently cooled by the influx of large amounts of cooling air into the bases since a first aperture is formed for ventilation about the periphery of the bases and since a second aperture for ventilation is formed at the tail edge of the bases. Accordingly, high temperature oxidation of external lead rods can be inhibited and an emission envelope lamp with a long life can be provided. Furthermore, external lead rods can be cooled more efficiently by mounting a heat dissipation section for external lead rods and lead lines and by mounting ventilation-concentration hoods at the first aperture.

The light-source device using such a discharge lamp can serve as a highly-reliable light-source device with a lower lamp replacement frequency. The total lamp length can be shorter than in the past since the external lead rod temperature is lower and the light-source device can be miniaturized.

What is claimed is:

1. A short-arc discharge lamp, comprising:

a pair of electrodes disposed facing each other within an emission envelope made of quartz glass, said emission envelope having a sealing tube connected at each end of said emission envelope, each sealing tube having a respective cylindrical base attached thereto;

external leads electrically connected to said electrodes and extending from each of said sealing tubes, said external leads being electrically connected to the respective cylindrical base, wherein each cylindrical base has a bottom at a tail end thereof and has at least one first ventilation aperture formed in a peripheral wall of the cylindrical base; and wherein at least one of the cylindrical bases has a second ventilation aperture formed in the bottom thereof, said ventilation apertures being open in a manner enabling air to pass therethrough out of the lamp.

2. The short-arc discharge lamp of claim 1 in which a heat dissipation section is formed at the external lead in the cylindrical base.

3. The short-arc discharge lamp of claim 1 in which said external leads comprise at least one of a lead rod and a lead line.

4. The short-arc discharge lamp of claim 1 in which a ventilation-concentration hood that conduct cooling air is provide at said at least one first ventilation aperture.

5. The short-arc discharge lamp of claim 1 in which the sealing tube on one side of said emission envelope is shorter than that on the opposite side of the emission envelope; and wherein said second ventilation aperture is formed in the bottom of the base on the shorter sealing tube.

6. The short-arc discharge lamp of claim 1 in which a corner aperture is formed at a corner between said bottom and said peripheral wall; and wherein a portion of the corner aperture formed on said peripheral wall constitutes said first ventilation aperture and a portion of the corner aperture formed on said bottom constitutes said second ventilation aperture.

7. A light-source device, comprising:

a short-arc discharge lamp having a pair of electrodes disposed facing each other within an emission envelope made of quartz glass, said emission envelope having a sealing tube connected at each end of said emission envelope, external leads electrically connected to said electrodes and extending from said sealing tubes, said external leads being electrically connected to a cylindrical base that has a bottom at a tail end thereof and is attached to each of said sealing tubes, each cylindrical base having at least one first ventilation aperture formed in a peripheral wall of said cylindrical base and at least one base having a second ventilation aperture formed in said bottom, said ventilation apertures being open in a manner enabling air to pass therethrough out of the lamp;

a concave reflection mirror surrounding the short-arc discharge lamp;

a lamp retaining plate for supporting said short-arc discharge lamp and a casing enclosing said short-arc discharge lamp and said mirror;

wherein a threaded section is formed about the peripheral wall of the cylindrical base, wherein an attachment hole is formed in the lamp retaining plate, and the short-arc discharge lamp is retained in the attachment hole of the lamp retaining plate by a matching threading in one of said attachment hole and a separate retaining nut.

* * * * *